US005253864A

United States Patent [19]

Heege et al.

[11] Patent Number: 5,253,864

[45] Date of Patent: Oct. 19, 1993

[54] WATER JUMP COURSE

[75] Inventors: Bernard Heege, Laubauch-Leienkaul; Hans Hofmann, Biel-Benken; Rudolf Heege, Kaisersesch, all of Fed. Rep. of Germany

[73] Assignee: Weber Karussell AG, Zurich, Switzerland

[21] Appl. No.: 927,680

[22] Filed: Nov. 6, 1986

[30] Foreign Application Priority Data

Mar. 1, 1986 [DE] Fed. Rep. of Germany ..... 3606728

[51] Int. Cl.[5] ..... A63G 21/00

[52] U.S. Cl. ..... 472/88; 472/89; 472/117

[58] Field of Search ..... 372/1 B, 56.5 R, 56.5 SS, 372/65, 71; 104/53, 54, 69, 70, 72, 82, 134; 482/26, 30–32, 55; 472/88–91, 116–117, 128–129

[56] References Cited

U.S. PATENT DOCUMENTS

| | | | |
|---|---|---|---|
| 783,425 | 2/1905 | Folks . | |
| 810,303 | 1/1906 | Ravel | 104/54 |
| 918,797 | 4/1909 | Tossel et al. | 104/54 |
| 1,027,437 | 5/1912 | Ridgeway | 272/56.5 R |
| 1,320,124 | 10/1919 | Chrul . | |
| 1,367,417 | 2/1921 | Moore . | |
| 1,467,293 | 9/1923 | Matheson | 104/70 |
| 2,225,425 | 3/1940 | Welch . | |
| 2,705,144 | 3/1955 | Ridgeway | 272/56.5 R |

FOREIGN PATENT DOCUMENTS

| | | | |
|---|---|---|---|
| 129145 | 3/1901 | Fed. Rep. of Germany . | |
| 528335 | 6/1930 | Fed. Rep. of Germany . | |
| 3017921 | 11/1981 | Fed. Rep. of Germany . | |
| 3229807 | 2/1984 | Fed. Rep. of Germany . | |
| 179794 | 12/1935 | Switzerland . | |
| 12884 | 8/1889 | United Kingdom | 272/56.5 R |
| 314654 | 7/1929 | United Kingdom . | |
| 1020677 | 2/1966 | United Kingdom | 272/65 |

*Primary Examiner*—Robert Bahr

*Attorney, Agent, or Firm*—Wood, Phillips, VanSanten, Hoffman & Ertel

[57] ABSTRACT

A water jump course comprises a jump slope, a boat and a water tank. The boat has front wheels and rear wheels with different gauges. In the lift-off zone of the jump slope, the rolling surface for the rear wheels is curved less markedly upwards than the rolling surface for the front wheels. Alternatively, the wheels may be of the same gauge and the rolling surface for the wheels at the jump slope lower end is movable in the vertical direction. An air cushion may also be provided in the landing area of the boat.

4 Claims, 4 Drawing Sheets

WATER JUMP COURSE

DESCRIPTION

1. Description of the Prior Art

A water jump course with a jump slope for the jumping of a boat occupied by a passenger into a water tank is known from German Patent No. 32 29 807. The boat rolls with its four wheels on the jump slope and at its rear end is connected to a traction cable which is conveyed to a windlass over a guide roller pulley at the upper end of the jump slope. After the boat has been boarded by its single passenger, it is pulled backwards up the jump slope by means of the windlass As soon as the driving motor of the windlass disengages from the boat, the latter accelerates in its path downwards along the jump slope. At its lower end, this jump slope has an upward curving runway, which imparts to the boat the desired take-off angle and the desired momentum so that the boat, after its phase of free flight, strikes against the water surface in the tank with an angle of incidence of approximately 10° to 30°.

This prior art water jump course has greatly proved its worth and it is particularly suitable for amusement parks. However, as discussed below, its capacity is very small, because the boat is designed for occupancy by only one passenger and the track of the system can only be operated with a single boat, with the result that the time interval between two jumps is relatively lengthy.

Specifically, the landing angle at which the boat of a water jump course lands has revealed itself in practical terms as being a very significant criterion for the satisfactory performance of the jump slope. Having accelerated to a definite speed along an inclined runway, the boat traeverses a curve of descent, at the end of which the rolling surface bearing the boat culminates in a space above the water surface of the water tank. The state of motion of the boat is supplemented, immediately after the boat has left the slope, by acceleration due to gravity, and these forces together determine the trajectory and the angle of landing of the boat. The significant parameters for the angle of landing are the lift-off angle, the torsional force around a horizontal traverse axis, and the projectile (i.e. boat) flight time.

The lift-off angle can be varied without significant disadvantages only within narrow limits, and the liftoff angle cannot alone ensure a correct angle of landing. Practical experience with the jump slope of the prior art, and the theoretically adduced evidence of the requisites for this slope that would render a landing agreeable to the passengers, demonstrate that the angle of landing (i.e., the angle between the longitudinal axis of the boat and the surface of the water) lies advantageously between 10° and 30°. Appreciably in excess of 30°, the horizontal deceleration becomes uncomfortably great, as does the vertical deceleration when the angle is appreciably under 10°. In order to maintain the angle of landing within the desired limits, the torsional force with which the boat rotates around a horizontal traverse axis during its projectile flight time must result in an angle which, when combined with the lift-off angle, will adhere to the boundary values, both when the boat is fully occupied and also when it is empty.

With the entry into the curve of descent, there is produced a torsional force, the magnitude of which is a function of the turning radius and of the velocity. Because, upon the lift-off from a conventional course, the front wheels leave the course earlier than the rear wheels in accordance with the distance between the axles, there is produced a nose-heavy torque which, depending upon the distance between the axles, the load status and the velocity, counteracts the positive torsional force either partly or entirely, or actually reverses it.

In the case of the above-mentioned prior art water jump course, these realities could be taken into account by providing a short distance between axles and an advantageous positioning of the undercarriage in relation to the center of gravity, with the rear axle positioned only slightly behind the center of gravity. This was possible because the boat is designed for only one passenger, and because no upwardly inclined stretches are traveled forward. These prerequisites have resulted, however, in the meager capacity of this equipment. They militate against a circuit comprising several boats, because, with such a circuit, an upward slope must of necessity be traveled forward and thus boat stability would require that the rear wheels be set farther back than is possible if a correct angle of landing is to be ensured.

Yet another problem with jump courses has been that when the angle of landing is kept sufficiently high, with the boat entering the water at a point rather than flat on its bottom, the rapid deceleration caused by the water causes a torque around a horizontal transverse axis. This leads to an abrupt pitch motion (which is unpleasant for the riders) and to additional horizontal deceleration, so that safety belts or the like are necessary.

It is an object of the present invention to overcome one or more of the problems as set forth above.

SUMMARY OF THE INVENTION

In one aspect of the present invention, a water jump course comprises a jump slope, a boat and a water tank. The boat has front wheels and rear wheels with different gauges. In the lift-off zone of the jump slope, the rolling surface for the rear wheels is curved less markedly upwards than the rolling surface for the front wheels.

In another aspect of the present invention, the wheels may be of the same gauge and the rolling surface for the wheels at the jump slope lower end is movable in the vertical direction.

In still another aspect of the present invention, an air cushion is provided in the landing area of the boat.

In this way it is ensured that, after the lift-off of the front wheels from the slope end, the torsional force of the boat, despite a long wheel-base and despite a varied load-weight of said boat, is only slightly reduced. Thus the landing angle of the boat in the tank can be maintained within a favorable range. Further, the undesirable landing torque is minimized.

It is an object of the present invention to ensure that the nose-heavy torque, which had previously been a factor in the lift-off, is only partly or not at all operative. Because of this, the distance between the axles can be substantially increased without the risk either of exceeding or of falling short of the favorable landing-angle range. Accordingly, the restrictions previously imposed by the distance between axles and by the position on steep stretches have been surmounted, and a high capacity system is provided with boats holding more than one passenger each and operating in a circuit.

DESCRIPTION OF THE PREFERRED EMBODIMENTS

Figure 1:
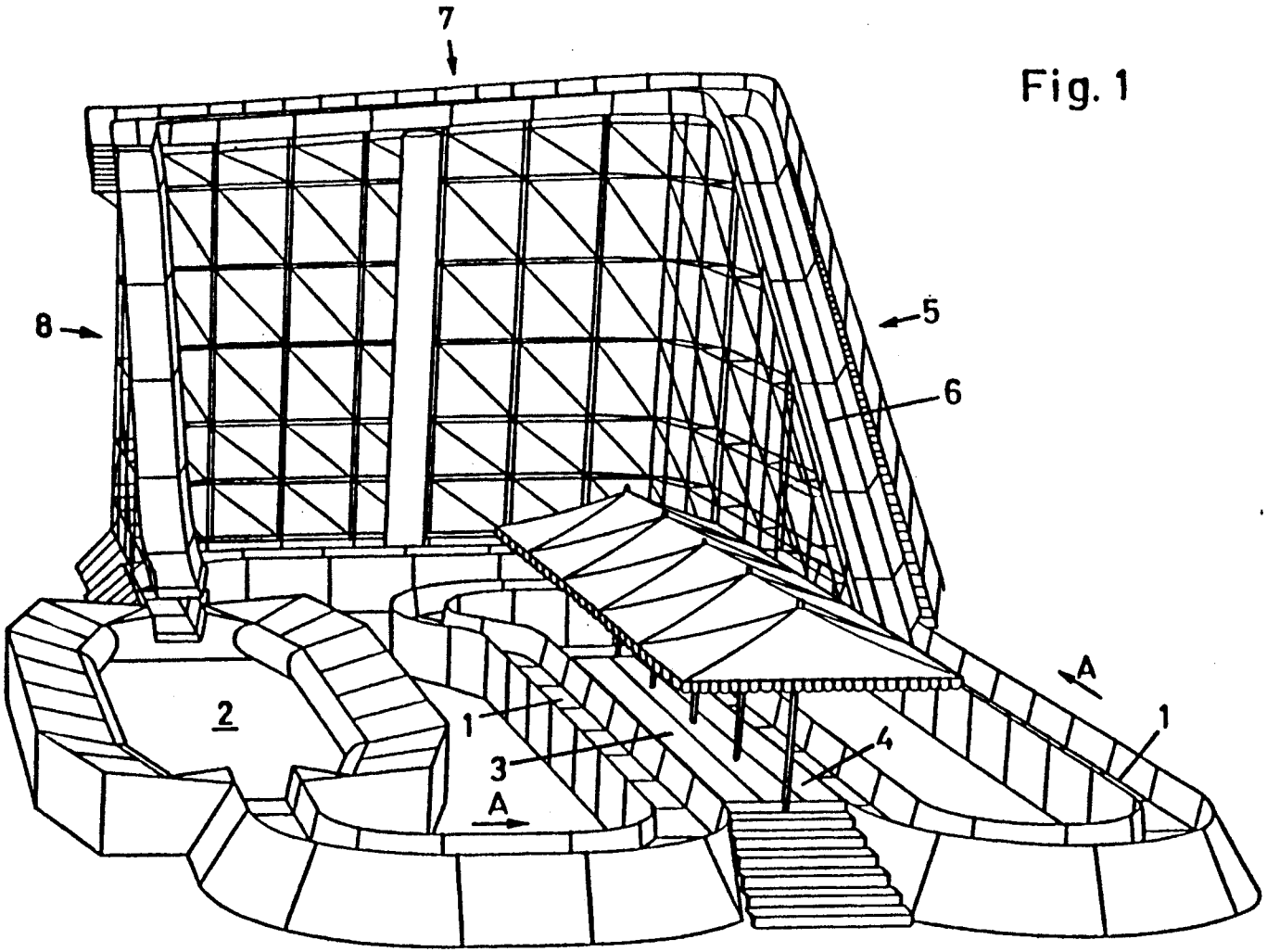
FIG. 1 is a perspective view of a water jump course.

A water jump course for the circuit of boats equipped with front and rear wheels is represented in FIG. 1. In a horizontal water trough 1, water is circulated in the direction of arrow A, by means of suitable pumps (not represented in the drawing). The water flows back into a water tank 2 and forward out of said tank 2 past an exit platform 3 and an entrance platform 4 to an incline 5 with a chain conveyor 6. The chain conveyor 6 raises circulating boats onto a slightly inclined stretch of runway drop 7, on which said boats roll on their wheels to a jump slope 8. After their jump over said slope 8, the boats land in the tank 2 and they are returned to the exit platform 3 by the circulating water.

Figure 2:
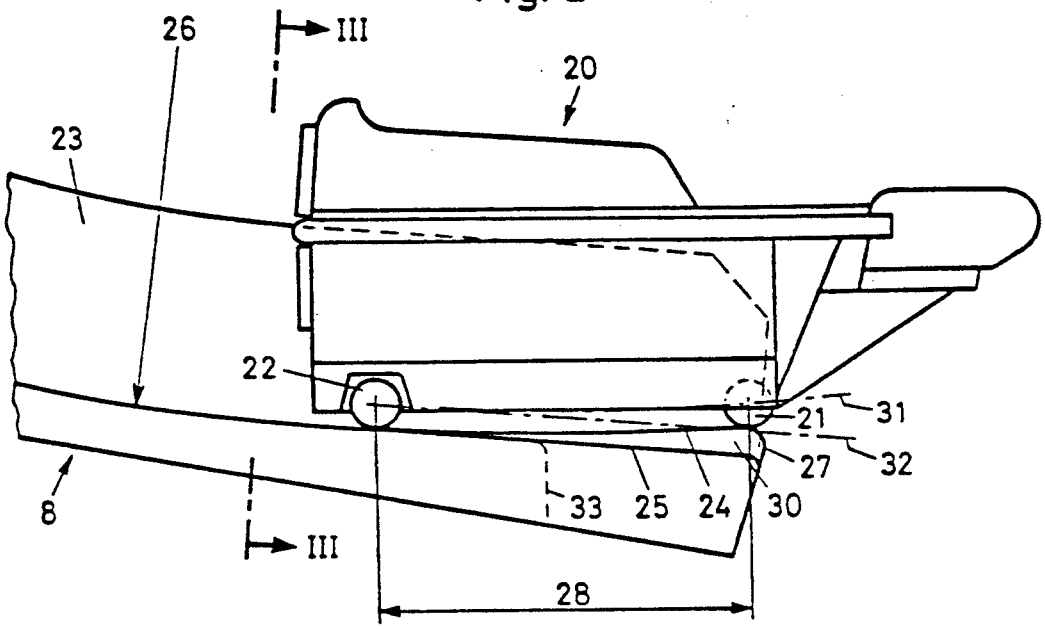
FIG. 2 is a lower portion of the jump slope of a first specific embodiment with a boat, in cross-section along line II—II of FIG. 3.
Figure 3:
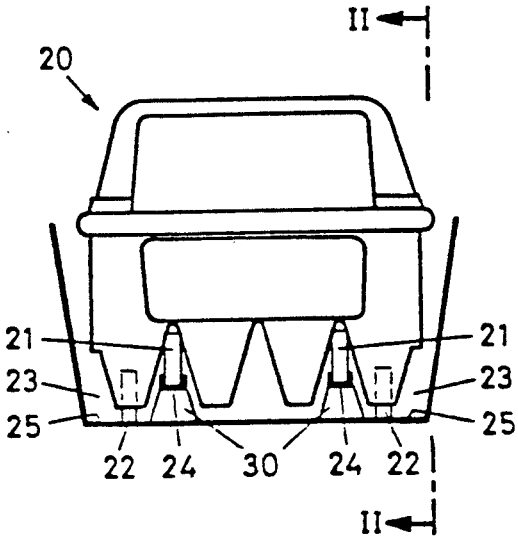
FIG. 3 is a transverse section along line III—III in FIG. 2.

A first specific embodiment of the lower portion of the jump slope 8 with an associated boat 20 is represented in FIGS. 2 and 3. The boat 20 is designed for two passengers, who are seated one behind the other, and has four wheels, the two front wheels 21 being of a narrower gauge than the two rear wheels 22. Accordingly, in the lift-off zone 28, the guide trough 23 of the jump slope 8 has a rolling surface 25 for the rear wheels 22 which is distinct and separate from the rolling surface 24 for the front wheels 21.

The rolling surface 24 for the front wheels 21 has, in the lower portion of the jump slope 8, a radius of curvature 26 which imparts a counterclockwise torsional force to the boat 20 as represented in FIG. 2. The rolling surface 24 for the front wheels 21 is formed by the upper side of two wedged dowels 30 which are installed on the floor of the guide trough 23.

After the front wheels 21 have lifted off from the end 27 of the jump slope 8, the force of the rolling surface 25 against the rear wheels 22 causes a clockwise torque, and therefore a decrease of the total torsional force. In order to limit this decrease of torsional force to the desired extent, the rolling surface 25 in the lift-off zone 28 (the length of which is substantially equal to the distance between the axles of the wheels 21,22) has a greater radius of curvature than rolling surface 24. As a result, the rolling surface 25 is sunk lower against the slope end 27 than rolling surface 24, and the tangent of rolling surface 25 to the slope end 27 is flatter than the tangent of rolling surface 24 to the slope end 27. In this way, the track 32 of the rear wheels 22 is also sunk lower against the slope end 27 relative to the track 31 of the front wheels 21, and the tangent of the track 32 of the rear wheels 22 to the slope end 27 is flatter than the tangent of the track 31 of the front wheels 21.

Despite the varying center of gravity that is caused by the varying number and weight distribution of the occupants in the boat 20, and despite the great distance between axles that is required for safe operation in the circuit, it is possible by this measure to ensure that the torsional force of the boat 20 during the lift-off of the rear wheels 22 from the slope end 27 can be kept within narrow limits. In this way, too, it is ensured that the landing angle of the boat 20 adheres to the optimal range of from 10° to 30°, regardless of the number of occupants in the boat 20.

Figure 4:
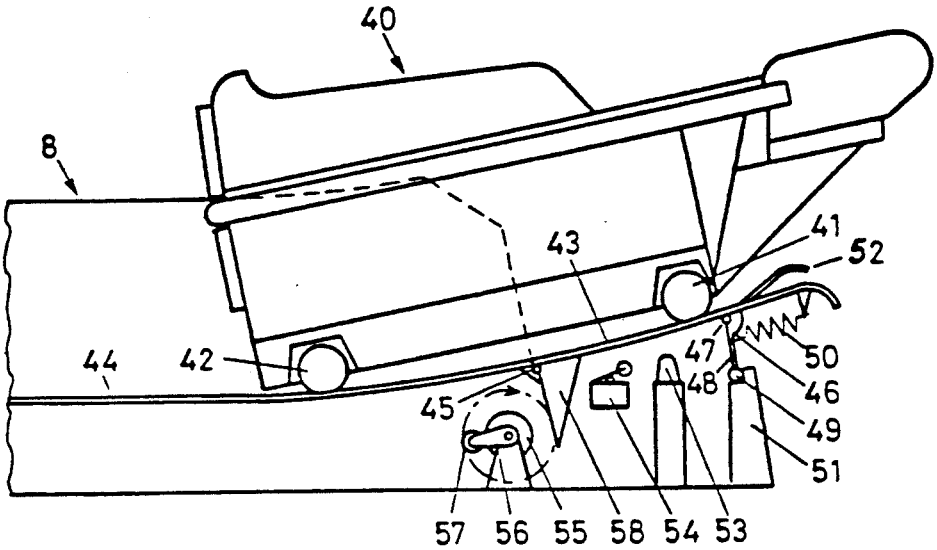
FIG. 4 is a longitudinal section similar to FIG. 2, but showing a second embodiment of the invention.

As is indicated by dashed lines in FIG. 2, the end 33 of rolling surface 25 for the rear wheels 22 can lie in front of the slope end 27 within the lift-off zone 28. In the borderline case in which the rolling surface end 33 is moved back to around the distance between the axles, the front wheels 21 and the rear wheels 22 rise up at the same time and the torsional force of the boat 20 at lift-off is completely independent of the center of gravity A second embodiment of the present invention is represented in FIG. 4. In this embodiment, the front wheels 41 of the boat 40 are of the same gauge as the rear wheels 42. An end segment 43 of the rolling surface 44 for the front wheels 41 and for the rear wheels 42 is pivotable around a horizontal axis 45 and is therefore movable in the vertical direction.

The end segment 43 bears, at its forward end, a two-arm lever 46 which is pivotable around a horizontal axis 47. One arm of the lever 46 is developed as a notched retainer 48 and bears at its free end a roller 49 which, in the normal position represented here, is biased into a support 51 by means of a tension spring 50. The other arm of the lever 46 is a tripping device 52 which projects beyond the rolling surface 44.

When the front wheel 41 runs over the tripping device 52, the roller 49 disengages from the support 51 and the end segment 43 rotates downward by its own weight around the axis 45. The rear wheel 42 then rises up from the rolling surface 44 already in the zone of axis 45, so that the same action is produced as with the moved-back end 33 of the rolling surface 25 in the embodiment shown in FIG. 2.

While dropping down, the end segment 43 strikes against a rubber buffer 53 and thereby actuates a limit switch 54, the switching pulse of which starts up a geared motor 55. A crank 56, which is rotated by the motor 55, pushes with a roller 57 against a lever 58, which is rigidly joined to the end segment 43, and raises the end segment 43 back into the represented normal position in which the notched retainer 48 engages in the support 51. After the crank 56 has rotated 360°, the motor 55 comes to a halt.

Figure 5:
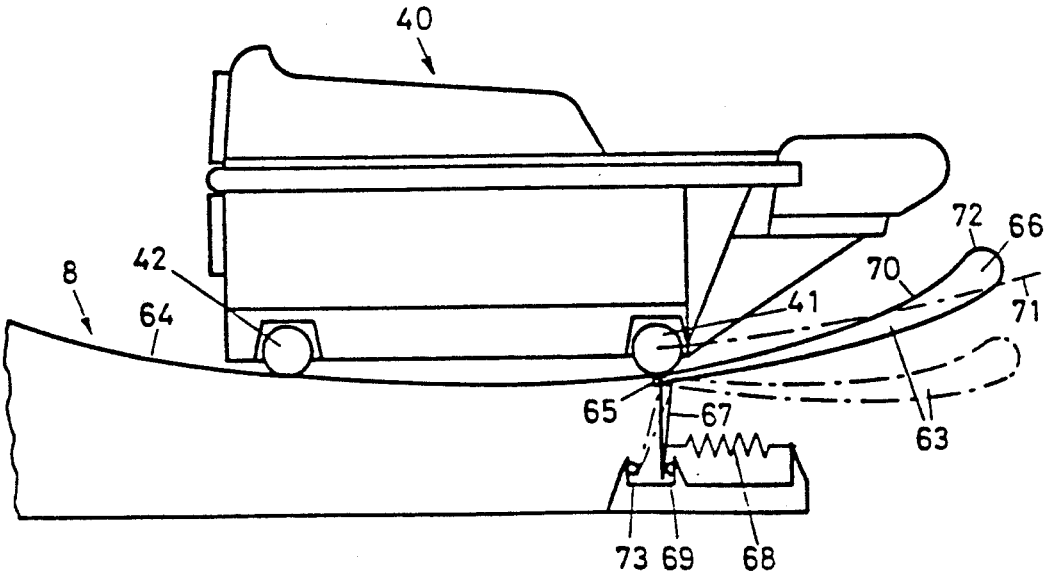
FIG. 5 is a longitudinal section similar to FIG. 2, but showing a third embodiment of the invention.

FIG. 5 represents yet another variant of the present invention, in which the boat 40 is identical to the one represented in FIG. 4 and thus likewise exhibits the same gauge for both the front wheels 41 and the rear wheels 42. An end segment 63 of the rolling surface 64 for the wheels 41,42 is again supported pivotably around a horizontal axis 65. The end segment 63 has a centrifugal mass 66 at its free end and is biased toward the represented normal position (by means of a tension spring 68) against a rubber buffer 69 by way of a lever 67 which is connected rigidly to the end segment 63. The radius of curvature of the upper side 70 of the end segment 63 is reduced in comparison with the free end.

The contour of the upper side 70, the centrifugal mass 66 and the spring 68 are suitably coordinated with one another in such a way that, when the front wheels 41 travel over the end segment 63, the reactive forces of the accelerated motion of the end segment 63 upon the wheels 41 imparts to the wheels 41 a course 71 which corresponds approximately to course 31 in FIG. 2. After the lift-off of the front wheels 41 from the slope end 72, the end segment 63 (because of its centrifugal mass 66), continues its rotary motion in the clockwise direction retarded by the spring 68. The rear wheels 42 thus lift off from the rolling surface 64 in the zone of the axis 65 and fly over the slope end 72 at approximately that point in time when the end segment 63 has arrived in the lower end position (represented by dashed lines) defined by the limit provided by an additional rubber buffer 73. With this alternative embodiment, therefore, the same action as that of the FIG. 4 embodiment is produced.

In order to reduce the requisite overall dimensions, the motion of end segment 63 can be transmitted onto a flywheel. And instead of the spring 68, it would also be possible to accomplish the biasing by means of a counter-weight.

Figure 6:
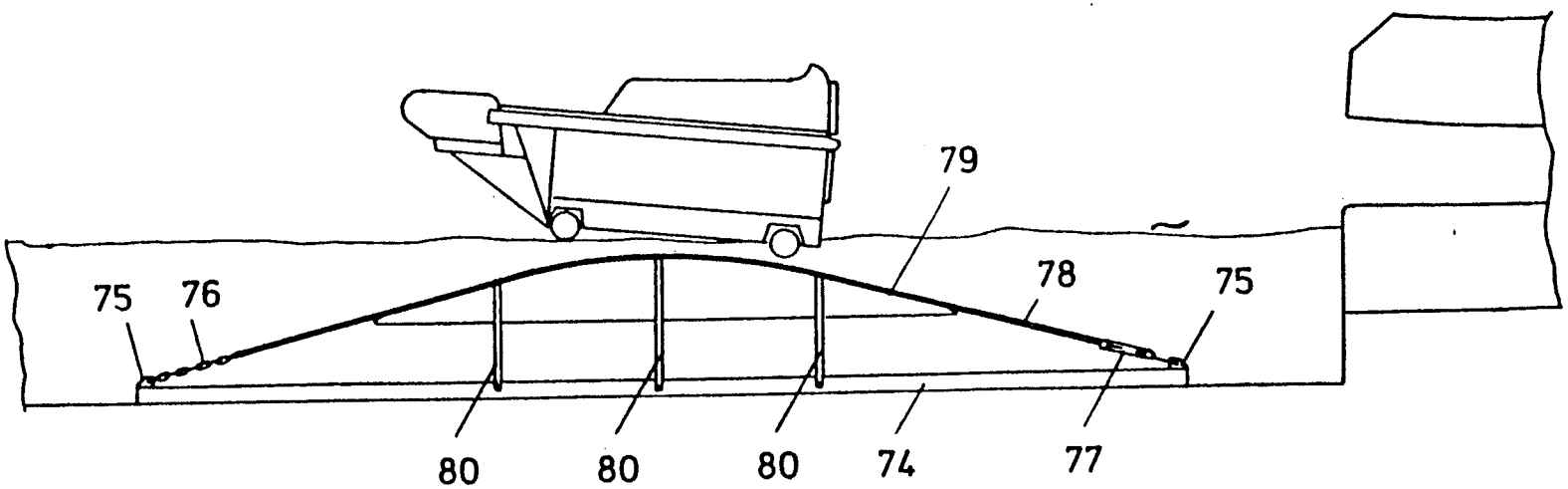
FIG. 6 is a longitudinal section showing the landing area for the boat.

In FIG. 6, one part of the water tank with the built-in air cushion and a landing boat is depicted in longitudinal section. A framework 74, which is connected with the tank's lower construction, has two connecting holes 75 at each end (only one can be seen at each end in the figure). A belt 78 is attached to these connecting holes 75 by means of two chains 76 at one end and two tightening screws 77 at the other end. Axially beneath the belt 78, a sack 79 manufactured from a flexible material, and partially filled with air, is positioned, which sack 79, through its buoyancy in the water, tightens the belt 78. In order for the sack 79 filled with air to not press out at the side, it is held by means of the holding bands 80 which are connected with the framework 74.

If an air cushion were not provided, a quantity of water corresponding to the volume of the submerged portion of the boat's body would have to be displaced within a very short time during landing. Since water is not compressible, not only would this quantity of water have to be displaced within a very short time, but a quantity of water would also have to be partially lifted up in the adjacent area, and another portion moved to the side. This would require great water acceleration values, and, as a reaction, corresponding decelerations of the boat. So that these values are not too great, a relatively great landing angle would be necessary so that the boat would not plunge flat on its surface, but rather would enter the water with a point. As a result, however, there would arise in connection with the horizontal movement at great speed a torque around a horizontal transverse axis, which would lead to an abrupt pitch motion (which is unpleasant for the riders) and to additional horizontal deceleration, so that safety belts or the like would be necessary.

Through the compressibility of the air in the air sack 79 positioned in the water, the quantity of water to be moved is considerably less when the sack 79 is provided as disclosed. Through this it is possible to select the landing angle to be substantially less, and so to make the pitch motion insignificant. The boat is decelerated relatively uniformly vertically over a longer range, and is then left on the water in a stable manner. There, in accordance with the water ski principle, it is raised to the surface, and is there horizontally decelerated somewhat.

We claim:

1. A water jum course for a boat with a front wheel and a rear wheel, characterized in that:

the course is a circuit with a water trough adjoining a water tank at the lower end of a jump slope having a roller surface for the wheels of said boat, said water trough being directed past an exit platform and an entrance platform to an incline where the longitudinal conveyor connecting the upper end of the incline to the upper end of the jump slope; and an end segment mounted to the slope lower end and movable between a normal upper position wherein the end segment forms a continuation of the rolling surface of the jump slope and a lower position when the end segment is moved downwardly in response to the front wheel of the boat rolling over the end segment, wherein said end segment is upwardly biased against a stop into its normal upper position, said end segment being operatively connected to a centrifugal mass for both exerting an upward force on a front wheel and moving the end segment to its lower position out of the path of the rear wheel of said boat.

2. The water jump course of claim 1, characterized in that a spring biases the end segment toward its normal upper position.

3. A water jump course for a boat with at least one front wheel and at least one rear wheel, comprising:

a water tank;

a jump slope having a rolling surface with a liftoff zone at a lower end of aid jump slope, said liftoff zone including a rigid end segment supported around a horizontal axis and movable between a normal upper position wherein the end segment forms a continuation of the rolling surface of the jump slope and a lower position when the end segment is moved downwardly in response to the front wheel of the boat rolling over the end segment, wherein said end segment is upwardly biased against a stop into its normal upper position, said end segment being operatively connected to a centrifugal mass for both exerting an upward force on the front wheel and moving the end segment to its lower position out of the path of the rear wheel of said boat.

4. The water jump course of claim 3, characterized in that a spring biases the end segment towards its normal upper position.

* * * * *